US006278240B1

(12) United States Patent
Yung

(10) Patent No.: US 6,278,240 B1
(45) Date of Patent: Aug. 21, 2001

(54) LOW INTERFERENCE LIGHTING SYSTEM

(76) Inventor: Simon K. C. Yung, 6 Purves Road, Jardine's Lookout Hong Kong (HK)

( * ) Notice: Subject to any disclaimer, the term of this patent is extended or adjusted under 35 U.S.C. 154(b) by 0 days.

(21) Appl. No.: 09/479,013

(22) Filed: Jan. 7, 2000

(51) Int. Cl.[7] ..... H05B 37/00
(52) U.S. Cl. ..... 315/85; 315/127
(58) Field of Search ..... 315/127, 119, 315/125, 126, 200 R, 85

(56) References Cited

U.S. PATENT DOCUMENTS 5,030,889 * 7/1991 El-hamamsy et al. ..... 315/200 R

* cited by examiner

*Primary Examiner*—David Vu
(74) *Attorney, Agent, or Firm*—Skjerven Morrill & MacPherson LLP

(57) ABSTRACT

A low-interference lighting system includes a housing, a voltage converter located within the housing, at least one pair of spaced-apart arms serving as electric elongated conductors extending from the housing, and a pair of special contact conductors for an external electrical device to tap into the electric elongated conductors. With respect to each arm, it includes an elongated conductor for carrying electric current and a grounded conducting shield surrounding, but electrically isolated from, the elongated conductor. External electrical devices, such as lamps make electrical contact with the elongated conductor via the contact conductors while insulated from the grounded conducting shield. In one embodiment, the pair of arms are rigid and in another embodiment, they are flexible.

10 Claims, 5 Drawing Sheets

LOW INTERFERENCE LIGHTING SYSTEM

FIELD OF THE INVENTION

The present invention relates to lighting systems, particularly ones that emit a minimum amount of interference signals.

BACKGROUND OF THE INVENTION

Lighting systems having a power source, structural and power connections to one or more light sources are widely used in industrial, commercial and domestic environments. Since these electrical systems may be extended and carry substantial amount of alternating current, substantial amount of electromagnetic ("EM") radiation may be generated. The EM radiation may interfere with the operation of co-existing electrical or electronic appliances. Therefore, regulatory authorities in various countries have mandated the maximum amount of EM radiation an electrical appliance may emit in a specified environment.

With the advent of the high efficiency light sources such as those using low voltage halogen lamps, the problem of EM interference becomes more acute. Many of these light sources operate with a much lower operating voltage than line voltage. A voltage converter or transformer is required to change the line voltage to the lower operating voltage. The conversion process often results in the generation of EM interference signals. This is particularly true for low-cost electronic voltage converters operating under the principle of power switching. The switching rate is typically in the radio frequency portion of the EM spectrum. Also, the lower operating voltage requires a higher operating current to maintain a given power output. The higher operating current also results in a higher emission of EM interference signals.

FIG. 1 illustrates schematically a top view of a conventional lighting system 10. The lighting system 10 is typically hung from a ceiling or mounted on a stand. It has a number of low voltage lamps 20 attached to and commuting with a pair of rails 30. The pair of rails are usually fashioned out of chrome plated copper or steel rods extending from a housing 40 and may terminate with a non-conducting, decorative end bar 32. The housing 40 houses a power supply which is typically a transformer or a voltage converter 50. The voltage converter 50 converts a line voltage such as 110 or 220 V AC at 50 or 60 Hz to a substantially lower voltage, e.g., 12 VAC, at a substantially higher frequency, e.g., 20 kHz. The voltage converter 50 outputs this lower voltage at higher frequency to electrify the pair of rails 30. The lamps 20 each has a pair of leads 22 that makes electrical contact with the pair of rails.

FIG. 2 shows a partial, perspective side view of the conventional lighting system 10 of FIG. 1. Since the rails 30 of the lighting system 10 carry high frequency and high current electrical power, they act as antennae emitting radio frequency EM emissions. These high frequency emissions interfere with the operations of surrounding electronics such as televisions, telephones, radios and computers.

OBJECTS AND SUMMARY OF THE INVENTION

It is a general object of the present invention to provide a lighting system with low interference.

It is an object of the present invention to provide an efficient, low-cost and low interference lighting system having electrified rails for supplying power to a plurality of electrical appliances such as light sources.

These and other objects of the present invention are accomplished by the lighting system including a housing, a voltage converter located within the housing, at least one pair of spaced-apart arms attached to the housing, and one or more electrical appliances such as light sources each mounted on a section of the pair of arms and making electrical contact with the arms by a pair of contact conductors. With respect to each arm, it includes an elongated conductor and a grounded conducting shield surrounding, but electrically isolated from, the elongated conductor. One contact of the pair of the contact conductors makes electrical contact with the elongated conductor and not the grounded conducting shield.

When the housing is connected to a power source, the voltage converter converts the line voltage of the power source to a substantially lower voltage at a substantially higher frequency and thereby outputs it to the elongated conductors of at least one pair of spaced-apart arms. Since the elongated conductors are shielded by the grounded conducting shield, they emit negligible interference signals while they provide power to the electrical appliances via the contact conductors.

BRIEF DESCRIPTION OF THE DRAWINGS

Other objects and features of the present invention and many of the attendant advantages of the present invention will be readily appreciated and become better understood by reference to the detailed description when considered in connection with the accompanying drawings in which like reference numerals designate like parts throughout the figures thereof and wherein.

DETAILED DESCRIPTION OF THE PREFERRED EMBODIMENTS

Figure 1:
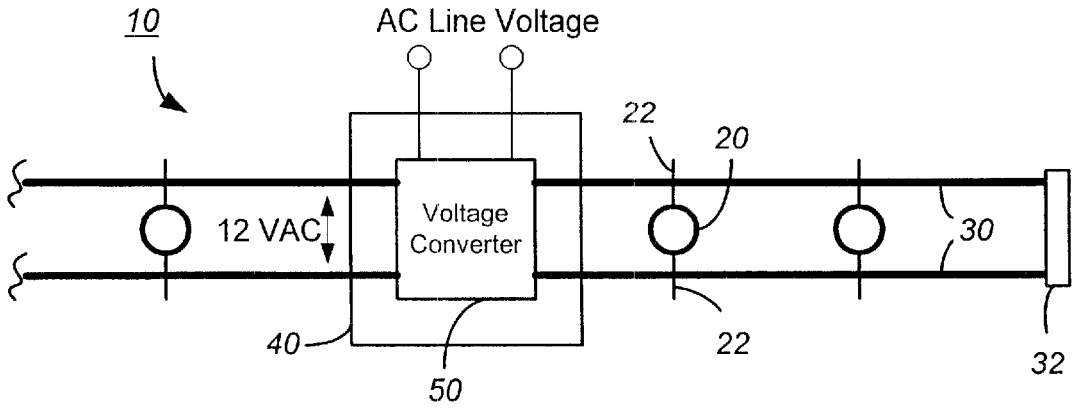
FIG. 1 (Prior Art)
FIG. 1 illustrates schematically a top view of a conventional lighting system.
Figure 2:
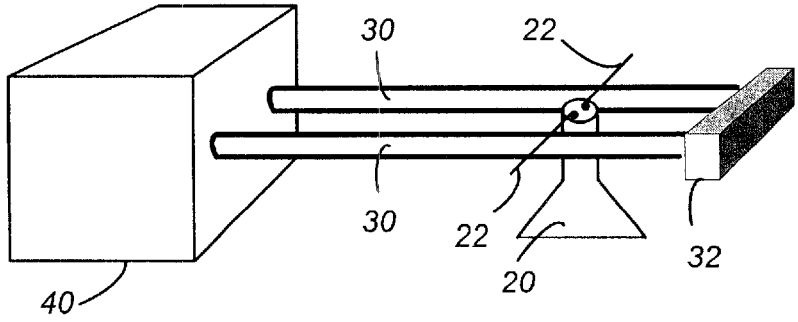
FIG. 2 (Prior Art)
FIG. 2 shows a partial, perspective side view of the conventional lighting system of FIG. 1.
Figure 3:
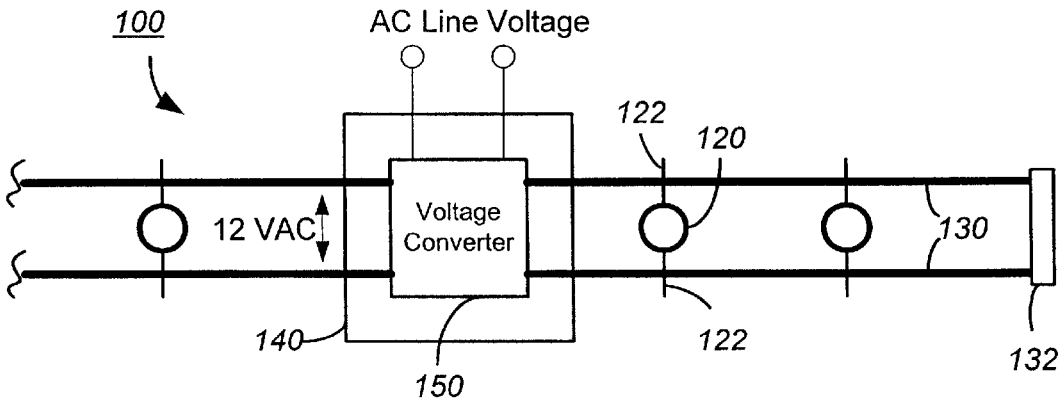
FIG. 3 illustrates schematically the general structure of a lighting system of the present invention comprising a pair of shielded elongated conductors.

FIG. 3 illustrates schematically the general structure of a lighting system of the present invention comprising a pair of shielded elongated conductors. Similar to that shown in FIG. 1, the lighting system 100 is typically hung from a ceiling or mounted on a stand. It has a number of low voltage lamps 120 coupled to a pair of arms 130.

The lighting system 100 comprises a housing 140 that houses a power supply which is preferably a voltage converter 150. The output of the voltage converter is supplied to electrify the pair of arms 130. The lamps 120 each has a pair of leads 122 that makes electrical contact with the pair of arms 130.

The voltage converter 150 converts a line voltage such as 110 or 220 VAC at 50 or 60 Hz to a substantially lower voltage, e.g., 12 VAC, at a substantially higher frequency, e.g., 20 kHz. In one embodiment, the down-converted voltage in AC form is used to power the lamps 120. In another embodiment, the down-converted voltage is further rectified into DC form before being supplied to the lamps 120. In either case, the voltage converter 150 initially generates the down-converted voltage at a higher frequency.

In one preferred embodiment, each of the pair of arms 130 is in the form of a rigid arm that extends from the housing 140 and physically terminates with a non-conducting, decorative end bar 132. As will be described in more detail later, the pair of arms 130 are constructed so as to minimize the antenna effect.

Figure 4B:
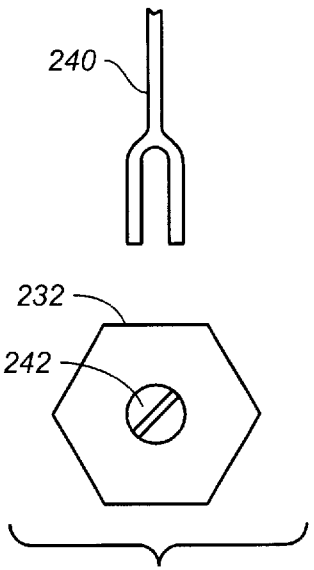
FIG. 4B illustrates a top view of the contact conductor of FIG. 4A.
Figure 4A:
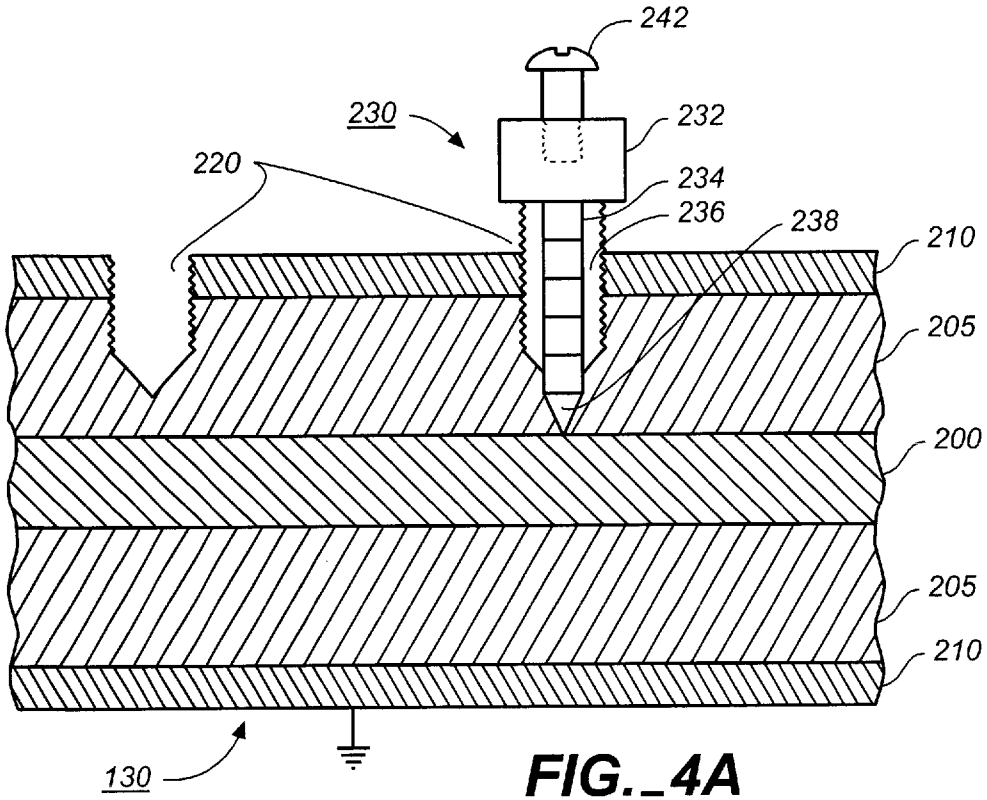
FIG. 4A shows a cross-sectional view of a rigid arm embodiment of the pair of shielded elongated conductors of FIG. 3, and the manner a contact conductor is making electrical contact with an inner elongated conductor of the rigid arm.

FIG. 4A shows a cross-sectional view of a rigid arm embodiment of the pair of shielded elongated conductors of FIG. 3, and the manner a contact conductor is making electrical contact with an inner conducting elongated conductor of the rigid arm.

Each arm of the pair of rigid arms 130 comprises an inner elongated conductor 200 surrounded by an insulator 205 that in turn is surrounded by an outer, grounded conducting shield 210. Thus, the grounded conducting shield 210 is electrically isolated from the inner elongated conductor 200. The inner conductor 200 is preferably formed from copper tubing or copper cable. The outer conductor 210 is preferably formed from copper or steel tubing with a decorative chrome plating. An insulating layer 205 is between the inner conductor 200 and the outer conductor 210. In the preferred embodiment, the insulating layer 205 and the inner conductor 200 may be economically implemented by an insulated electrical cable where its outer diameter of its insulating shield is such that the cable fits snugly inside the outer tube 210.

Pre-cut holes or access ports 220 are formed at predetermined locations along the length of the outer conductor shield 210. Alternatively, any number of these access ports 220 may be formed at a desirable location after the lighting system has been deployed in the field. Each of the access ports 220 allows one of the contact conductors 230 to make contact with the inner conductor 200.

With respect to the contact conductor 230, it is in the form of a conducting screw that has a nut head 232 and a shaft body 234. The shaft body is surrounded by an insulator sheath 236 to the extent a tip end 238 of the shaft body is exposed for making electrical contact with the inner conductor 200. The insulator sheath 236 is preferably formed from hard plastics or ceramic and is threaded for screwably engaging into one of the access ports 220. As a result, the contact conductor 230 makes electrical contact with the elongated conductor 200 but is insulated from the grounded conducting shield 210.

FIG. 4B illustrates a top view of the contact conductor of FIG. 4A, on which a lead with a spade head 240 from a lamp is attachable to the nut head 232 by means of a screw 242.

Figure 5:
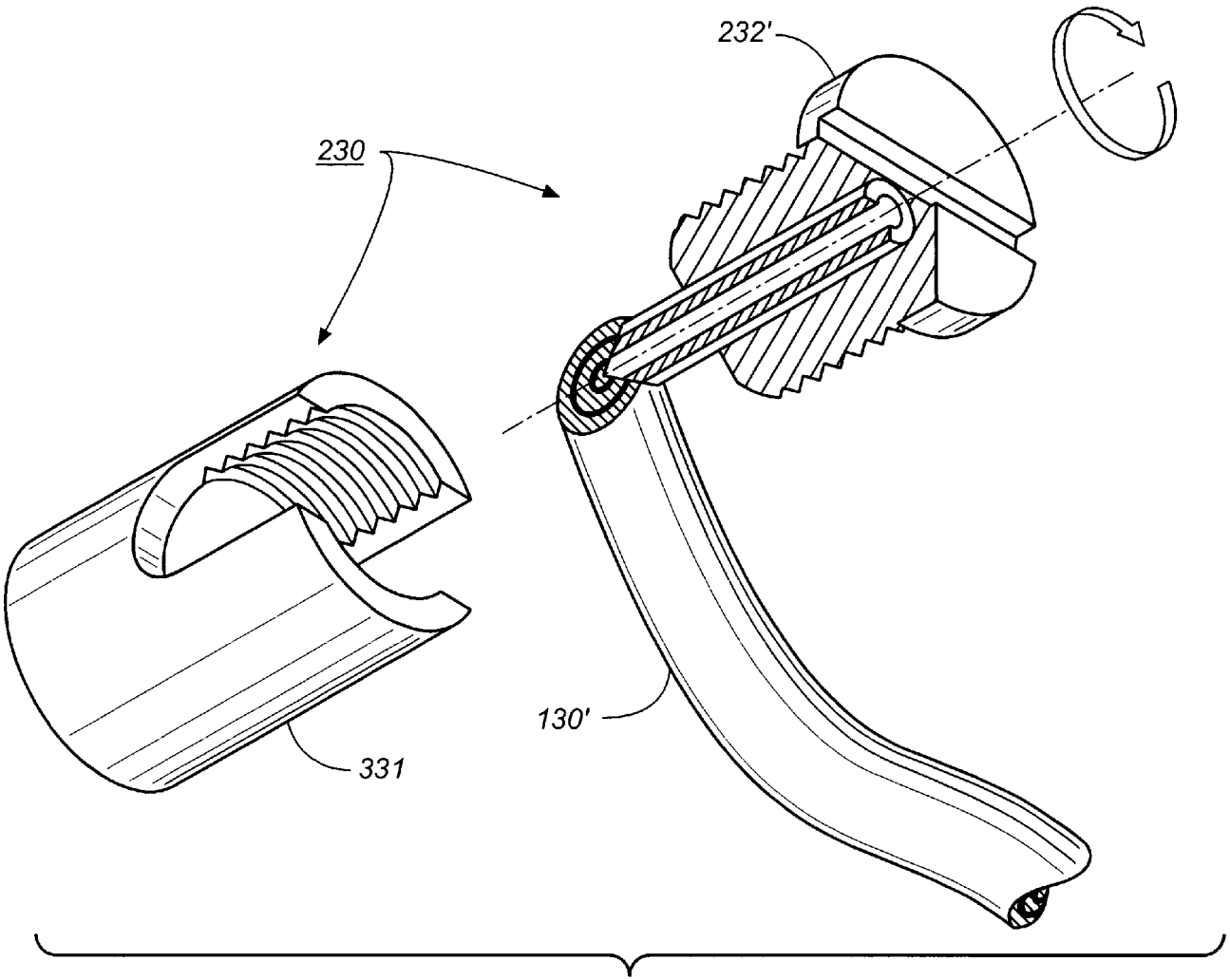
FIG. 5 illustrates a lighting system with the pair of shielded elongated conductors as flexible arms according to an alternative preferred embodiment of the present invention.

FIG. 5 illustrates a lighting system with each of the pair of shielded elongated conductors as a flexible arm 130' according to an alternative preferred embodiment of the present invention This alternative embodiment is similar to the first embodiment described earlier in connection with FIGS. 4A & 4B except, each arm 130' is flexible instead of rigid. Each flexible arm extends from the power source housing 140 (see FIG. 3) and typically terminate at the other end by attaching to a wall (not shown). A contact conductor 230 comprising a retaining nut 331 is used to tap into the flexible arm 130'.

Figure 6:
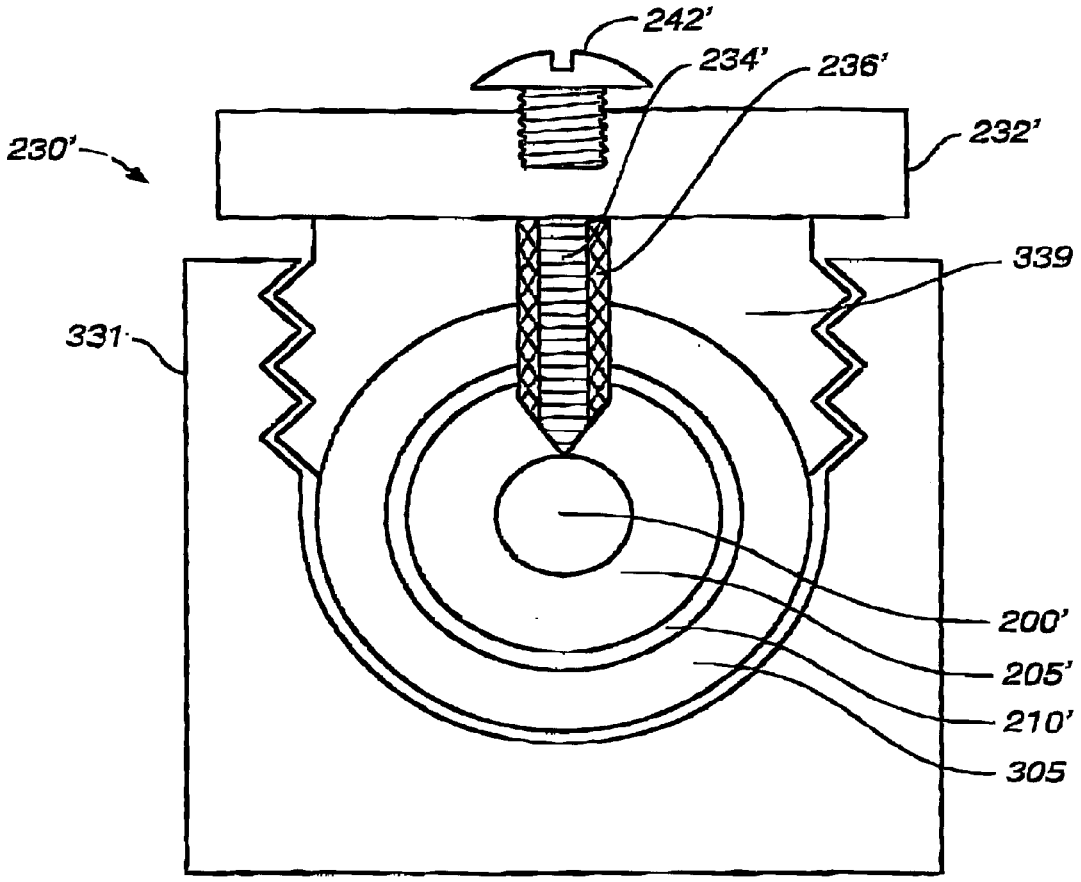
FIG. 6 is a cross-sectional view of the flexible arm of FIG. 5 and the manner a contact conductor is making electrical contact with an inner conductor of the flexible arm, according to an alternative embodiment of the present invention.

FIG. 6 shows a cross-sectional view of the flexible arm engaged by a contact conductor 230'. Each flexible arm 130' is preferably formed by a coaxial cable having an inner conductor 200', an insulating layer 205', an outer conductor 210' and an outer insulating layer 305.

Similar to the rigid embodiment described earlier, access ports are opened at the surface of the coaxial cable for the contact conductor 230' to make contact to the inner conductor 200' while remain insulated from the outer conductor 210' which is grounded.

With respect to the contact conductor 230', it is similar to that shown in FIGS. 4A and 4B in that it is in the form of a conducting screw that has a nut head 232' and a shaft body 234'. The shaft body is surrounded by an insulator sheath 236' to the extent a tip end 238' of the shaft body is exposed for making electrical contact with the inner conductor 200'. The insulator sheath 236' is preferably formed from hard plastics or ceramic.

Unlike the one shown in FIG. 4A, the insulator sheath 236' is not threaded. Instead, the contact conductor 230' is engaged into the flexible arm 130' by means of the retaining nut 331. The contact conductor 230' has a outer sheath 339 that is threaded and is screwable onto the retaining nut 331. As the contact conductor 230' is screwed into the retaining nut, the shaft body 234' comes into contact with the inner conductor 200' of the flexible arm 130' while remaining insulated from the grounded outer conductor 210'.

Thus, electrical appliance systems in which power is delivered by electrified elongated conductors are described in which the electrified elongated conductors are shielded to minimized electromagnetic interference. In particular, the shielded electrified elongated conductors are substantially coaxial in structure, and special contact conductors are implemented to connect to them.

With the present invention has been described in conjunction with several alternative embodiments, these embodiments are offered by way of illustration rather than by way of limitation. Those skilled in the art will be enabled by this disclosure to make various modifications and alterations to the embodiments described without departing from the spirit and scope of the present invention. Accordingly, these modifications and alterations are deemed to lie within the spirit and scope of the present invention as specified by the appended claims.

It is claimed:

1. A low-interference lighting system, comprising:

a voltage converter for converting a first voltage to a second voltage, said second voltage having two poles;

a housing containing said voltage converter;

at least one pair of spaced-apart arms extending from said housing;

each arm further comprising:

an elongated conductor connectable to one pole of said second voltage;

a grounded conducting shield surrounding, but electrically isolated from, said elongated conductor; and a contact conductor making electrical contact with said elongated conductor through a port on said conducting shield along said arm for supplying one pole of said second voltage to a lamp.

2. A low-interference lighting system as in claim 1, wherein:

said contact conductor includes a conducting pin, said conducting pin further comprises:

a screwable head;

a shaft body having a screw head end and a tip end; and a threaded insulator protecting a substantial portion of the shaft body but exposing the tip end such that when said contact conductor is screwed into the port on said grounded conducting shield, said contact conductor is making electrical contact with said elongated conductor but insulated from said grounded conducting shield.

3. A low-interference lighting system as in claim 1, wherein said elongated conductor includes one that is a wire.

4. A low-interference lighting system as in claim 1, wherein said elongated conductor includes one that is tubular.

5. A low-interference lighting system as in claim 1, wherein:

each said arm is in the form of a coaxial cable having an inner conductor as said elongated conductor and concentric with an outer conducting shield as said grounded conducting shield.

6. A low-interference lighting system as in claim 5, wherein:

said contact conductor includes a conducting screw for screwing into a cable-retaining receptacle nut, said conducting screw further comprises:

a screwable head;

a shaft body having a screw head end and a tip end;

an insulator sleeve protecting a substantial portion of the shaft body but exposing the tip end; and an outer annular threaded body surrounding said insulator sleeve but exposing a portion of said insulator sleeve near the tip end such that when said contact conductor is screwed into the port on said grounded conducting shield, said contact conductor is making electrical contact with said elongated conductor but insulated from said grounded conducting shield.

7. A low-interference lighting system as in anyone of claims 1–6, wherein:

said first voltage includes line voltage.

8. A low-interference lighting system as in anyone of claims 1–6, wherein:

said second voltage includes one substantially lower than said first voltage.

9. A low-interference lighting system as in anyone of claims 1–6, wherein:

said second voltage includes one having an alternating frequency substantially higher than that of said first voltage.

10. A low-interference lighting system as in anyone of claims 1–6, wherein:

said elongated conductor and said grounded conducting shield form a concentric tubular arm.

* * * * *